US008141715B2

(12) United States Patent
Helmy

(10) Patent No.: US 8,141,715 B2
(45) Date of Patent: Mar. 27, 2012

(54) SIFTING SCREEN

(75) Inventor: Nashat N. Helmy, West Bloomington, MN (US)

(73) Assignee: Tandem Products, Inc., Minneapolis, MN (US)

( * ) Notice: Subject to any disclaimer, the term of this patent is extended or adjusted under 35 U.S.C. 154(b) by 76 days.

(21) Appl. No.: 12/550,170

(22) Filed: Aug. 28, 2009

(65) Prior Publication Data

US 2010/0258484 A1 Oct. 14, 2010

Related U.S. Application Data

(63) Continuation-in-part of application No. 12/422,461, filed on Apr. 13, 2009, now abandoned.

(51) Int. Cl.
*B07B 1/49* (2006.01)

(52) U.S. Cl. ..... 209/403

(58) Field of Classification Search ..... 209/319, 209/399, 403, 405, 408
See application file for complete search history.

(56) References Cited

U.S. PATENT DOCUMENTS

| | | | | |
|---|---|---|---|---|
| 3,092,573 | A * | 6/1963 | Lambert et al. | 209/403 |
| 3,655,045 | A * | 4/1972 | McAllister, Jr. | 209/379 |
| 3,684,091 | A * | 8/1972 | Wehner | 209/403 |
| 3,833,120 | A * | 9/1974 | Ogata | 209/399 |
| 4,247,007 | A * | 1/1981 | Kai | 209/392 |
| 4,857,176 | A * | 8/1989 | Derrick et al. | 209/392 |
| 5,326,460 | A * | 7/1994 | Cheesman et al. | 210/160 |
| 5,332,101 | A * | 7/1994 | Bakula | 209/403 |
| 5,636,749 | A * | 6/1997 | Wojciechowski | 209/403 |
| 6,659,286 | B2 * | 12/2003 | Seyffert et al. | 209/405 |
| 6,892,888 | B2 * | 5/2005 | Schulte et al. | 209/405 |

* cited by examiner

*Primary Examiner* — Joseph C Rodriguez
(74) *Attorney, Agent, or Firm* — Nawrocki, Rooney & Sivertson, P.A.

(57) ABSTRACT

Attachment apparatus by which a sifting screen is mounted to a tension rail of a shaker machine. The apparatus includes a portion of the sifting screen wherein a hem at the periphery thereof has a thickness smaller than that of an interior portion of the sifting screen. The hem portion further includes a wire cloth array which is cast in the hem portion. A shroud includes upper and lower segments which are folded back on each other. A hinge edge is thereby defined. Facing surfaces of the upper and lower segments of the shroud sandwich the hem portion of the sifting screen therebetween. Means are provided to inhibit movement of the facing surfaces across engaged surfaces of the hem portion.

8 Claims, 3 Drawing Sheets

FIG. 6
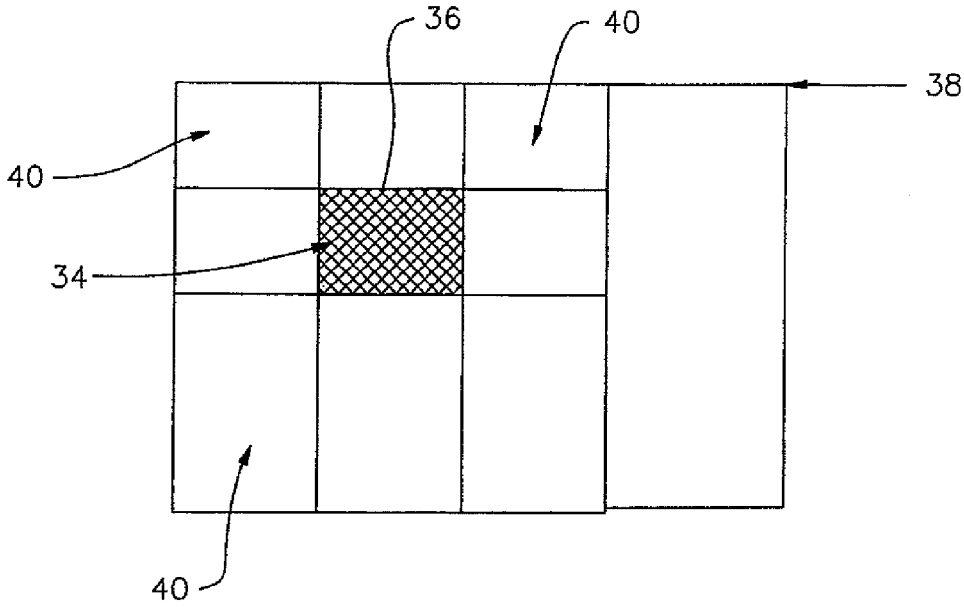
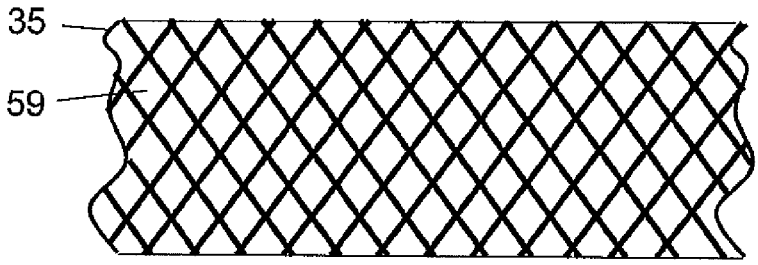
FIG. 7
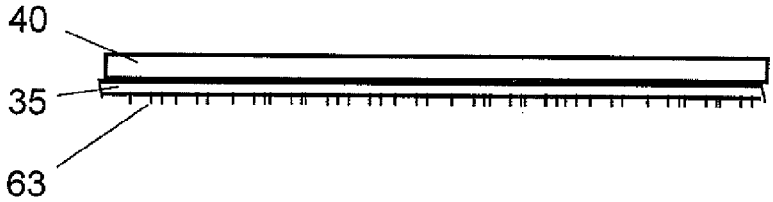
FIG. 8

SIFTING SCREEN

CROSS-REFERENCE TO RELATED APPLICATIONS

This application is a continuation-in-part claiming priority of application Ser. No. 12/422,461, previously filed Apr. 13, 2009 now abandoned under 35 U.S.C. §111(a).

TECHNICAL FIELD

The present invention deals broadly with large sifting apparatus used to size granular material as it is sifted by the apparatus. More narrowly, however, it is directed to screens, either the full sifting apparatus or modules thereof, used in classifying the granular material by size. A specific focus of the invention is structure employed to mount a screen to a mechanism for shaking the screen during the performance of the classification function.

BACKGROUND OF THE INVENTION

Large aggregate sifting machinery for classifying material by size is well-known in the art. A number of problems are, however, prevalent with regard to such machinery. One problem is cost. Because of typically rapid deterioration, the useful life of an apparatus can be quite short.

Another problem is clogging. Frequently, ambient dust can accumulate and fill holes through which the material to be classified passes. Depending upon various conditions such as moisture, obstruction of apertures can render such machinery at least temporarily non-operational.

Another concern deals with transportability. Any number of components of such a sifting apparatus can be quite heavy, and such a machine can be rendered virtually immobile.

A final issue which must be considered in the design of a sifting screen is the secure attachment and maintenance of a screen portion to a tension rail which circumscribes the location at which the screen portion is to be mounted. The screen portion must be securely attached and so maintained in order for the overall apparatus to function properly and securely.

It is to these shortcomings and problems of the prior art that the present invention is directed. It is an improved sifting apparatus which addresses these problems and shortcomings. Because of the construction of an apparatus in accordance with the present invention, these shortcomings are overcome.

SUMMARY OF THE INVENTION

The invention is a sifting screen which includes a screen portion to be attached to a tension rail of a shaker apparatus. The screen portion, in turn, employs an apertured matrix defined by the intersection of segments which form the matrix. The matrix is made primarily of an elastomeric material having elastic properties that can allow the screen to operate under high tension without significant yield. A frame extends about at least a portion of the periphery of the matrix. The frame includes a plurality of hooks mounting the matrix of the screen portion to a shaker bed. With the matrix so disposed, the sifting screen can be used to sift a particular volume of material. The frame is shaped and sized relative to locations of attachment to the shaker bed.

The matrix is afforded a degree of elasticity so that mounting of the screen portion to the shaker bed is accomplished by stretching and tensioning the matrix in such a way so as to form the screen over a bucker bar of the shaker bed. The screen portion is defined in part by a pair of opposite, generally arcuate, non-parallel edges, each of which has a relatively long radius of curvature. Mounting the screen portion to the shaker bed in a manner wherein alternate parallel edges carry mounting hooks causes the matrix surfaces to vibrate during sifting operations, wherein it generates a wave-like motion having longitudinal movement as well as surface vibration. Vibration of the matrix facilitates cleaning of the apparatus and does not permit specific particles and fine powder to accumulate. Consequent occluding of apertures in the screen portion is thereby obviated.

It will be understood that, because of the elastic nature of the matrix, it can be folded for transportation. This enables the apparatus to be quite mobile.

The hooks devised for mounting the matrix of the screen portion to a shaker bed are formed using a hem of the sifting screen portion. The hem is afforded a thickness smaller than that of an interior portion of the sifting screen. The hem can have a wire cloth array cast therein, but it will be understood that the hook can be formed even without using such an array. A shroud is formed by employment of a structure having upper and lower segments. Such segments are folded back upon each other to define a hinge, and wherein facing surfaces of the upper and lower segments define facing surfaces which sandwich the hem therebetween. The segments, it will be understood, pivot with respect to the hinge defined by manipulating the segments. Facing surfaces defined within the shroud sandwich the hem therebetween.

If desired, means can be employed to inhibit movement of the facing surfaces across the hem portion. Such structure can take the form of a patch of expanded metal welded to each of the facing surfaces opposite one another. The expanded metal patches can have, defined therein, apertures, the edges of which include burrs. Such burrs, when the shroud upper and lower segments are pivoted about the hinge and brought into contact with the hem portion, dig into the hem.

The shroud, when facing surfaces of the segments sandwich the hem portion therebetween, can be bent to define an angle. The angle is a function of the cross-section of the tension rail to which the sifting screen is to be attached. That is, the hook will be bent to an angle appropriate for securely attaching the sifting screen to the tension rail.

The invention is thus an improved sifting screen apparatus.

More specific features and advantages obtained in view of those features will become apparent with reference to the DETAILED DESCRIPTION OF THE INVENTION, appended claims and accompanying drawing figures.

BRIEF DESCRIPTION OF THE DRAWINGS

FIG. 6 is a top plan view illustrating an alternative, modular embodiment.

FIGS. 7 and 8 are respectively face and edge views of a portion of an expanded metal gripping patch and the surrounding structure.

DETAILED DESCRIPTION OF THE INVENTION

Figure 1:
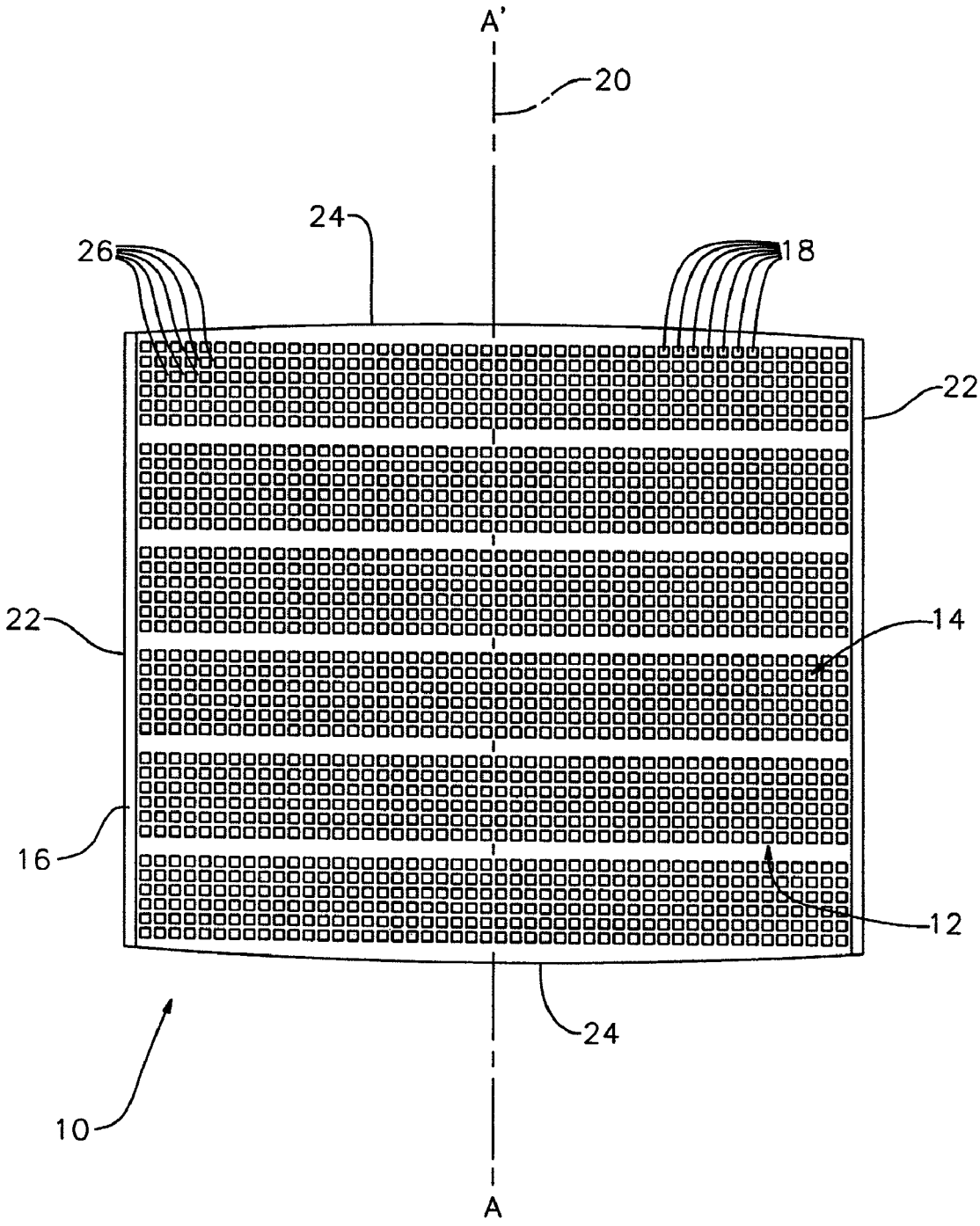
FIG. 1 is a top plan view of the screen portion of a sifting screen mechanism in accordance with the present invention.

Referring now to the drawing figures wherein like reference numerals denote like elements throughout the several views, FIG. 1 illustrates a sifting screen 10 in accordance with the present invention. The screen 10 includes a screen portion 12 formed by an apertured matrix 14. The matrix 14 is formed from an elastomeric material. Typically, the matrix 14 is homogeneously elastomeric being formed of a material such as polyurethane, rubber or another polymer which, when tensioned, has a low yield with a targeted modulus of elasticity. The elastic nature of the matrix 14 is for a purpose discussed hereinafter. The matrix 14 is formed by a multiplicity of intersecting, elastic segments 26 of material. The intersecting segments 26 thereby define a multiplicity of apertures 18 through which a granular-like material can pass during a sifting operation of the screen 10.

The overall sifting screen 10 is typically substantially rectangular in shape, but it can assume other geometric configurations. It is defined by a pair of opposite, substantially linear edges 22 which extend parallel to, and on opposite sides of, a central axis 20. Further, edges 24 of the sifting screen are defined by slightly outwardly bowed portions. The arcuate, bowed edges have a relatively large radius of curvature. Consequently, the bowing is relatively slight.

Lateral edges 22 further provide frame sections 16. These sections 16 would, it is intended, mount a plurality of hook members 28 as best seen in FIGS. 2-5. Hook members 28 are, typically, of a type and design as known in the prior art. They can be mounted along the generally parallel, lateral edges 22 of sifting screen 10. They can be spaced at appropriate intervals for cooperative engagement with corresponding locations on a shaker bed (not shown).

Figure 2:
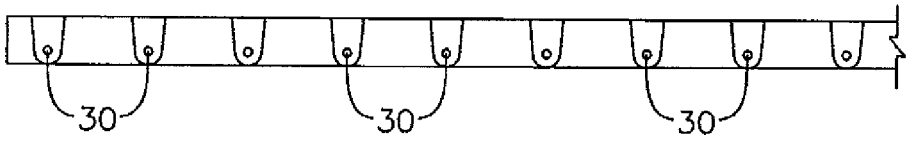
FIG. 2 is a side sectional view of a sifting screen as cast.

FIG. 2 shows a wire screen as cast. The particular screen illustrated utilizes a peripheral network of wires 30 running through the matrix. Typically, such a network is a continuation of such a network running through the matrix of the sifting screen 10.

Figure 3:
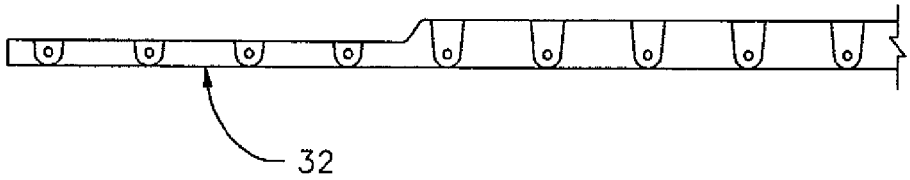
FIG. 3 is a view similar to FIG. 2 but with a hem portion flattened to a lesser thickness.

FIG. 3 illustrates the segment of the cast material with a hem 32 thinner than the rest of the screen. It will be understood that the specific dimensions of the structure will vary depending upon the dimensions and parameters of the overall apparatus being used. For example, in one application, the width of the hem 32 can be made to extend approximately two feet to three feet. The thickness of the thinned hem 32, in such an application, would be approximately three inches.

Figure 4:
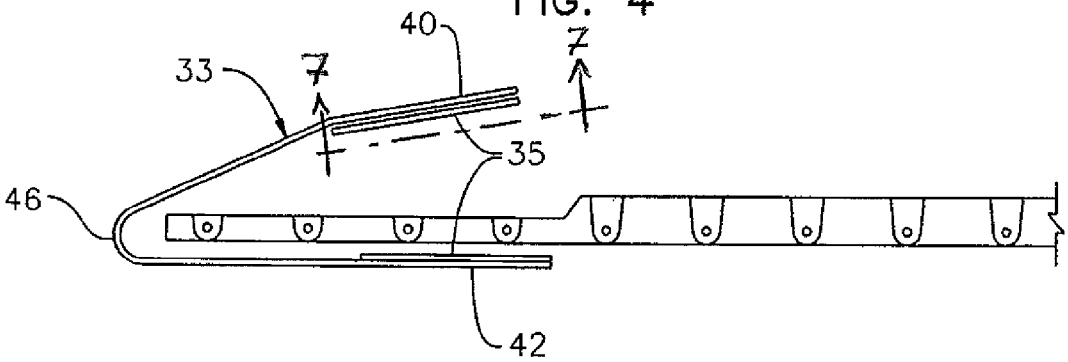
FIG. 4 is a view similar to FIGS. 2 and 3 illustrating attachment of a shroud structure.

FIG. 4 illustrates a shroud 33 having upper and lower segments 40, 42 bent about a hinge portion 48, sandwiching the hem 32 of the sifting screen therebetween. In order to effect a more secure capturing of the hem 32 by the shroud 33, patches a patch of expanded metal 35 are shown as being secured to the facing surfaces of the shroud 33. These expanded metal patches 35 would, typically, be welded to the upper and lower segments 40, 42 of the shroud. It will be understood, however, that any method of affixation would be appropriate.

The expanded metal patches 35 and the shroud 33 are shown in more detail in FIGS. 7 and 8. Metal patches 35 have a plurality of apertures 59 formed therein. The edges of the apertures 59 include burrs 63 shown in FIG. 8. Burrs 63 may be formed as a by-product of the sheet metal slitting step that occurs during the production of expanded metal. The burrs 63, when the shroud upper and lower segments 40, 42 are bent at the hinge 46 and brought into contact with the hem portion 32, dig into and securely grip the hem 32. It is contemplated that the apertures 59 would be generally diamond-shaped to give significant holding.

Figure 5:
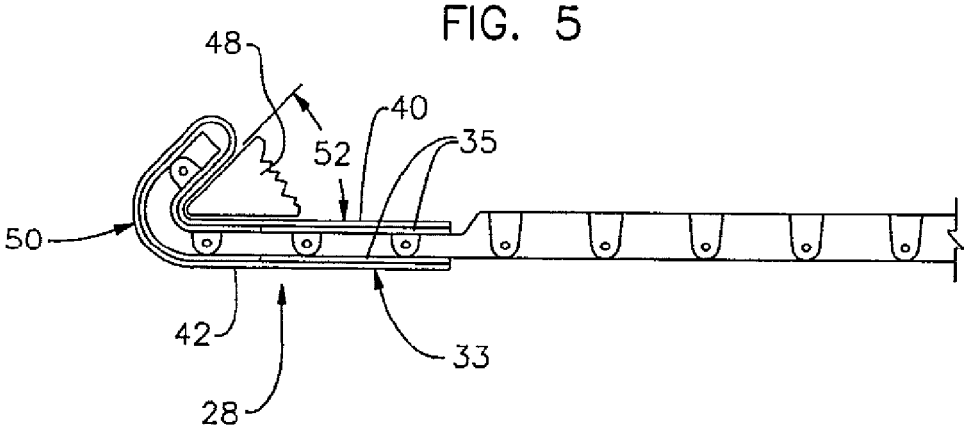
FIG. 5 is a view similar to FIGS. 2-4 illustrating the bending of the shroud to attain an attachment configuration.

Referring to FIG. 5, it will be seen that the shroud 33 is bent back upon itself to form means for attaching the sifting screen to the tension rail to which it is to be mounted. That figure illustrates a portion of a tension rail 48 having an apex 50 which defines an angle measuring approximately 45 degrees. Consequently, the degree of bend of the shroud 33 will be approximately that same measure.

As previously discussed, the screen portion and matrix 14 thereof are elastomeric in nature. The degree of this attribute afforded to the matrix 14 is a calculated figure which will enable the matrix 14 to be both stretched for mounting and appropriately tensioned to facilitate optimum operation of the sifting screen 10.

The bowing of forward and rearward edges 24 enables the sifting screen 10, in operation, to not only vibrate to accomplish sifting of a granular material placed on an upper side thereof. Further, in view of the tensioning of the bowed edges 24, longitudinal movement of the media along the screen portion will also be enabled. This results from the generation of a wave-like motion during sifting operations. When the screen is in tension along the A-A' axis, the entire screen is subject to linear tension, for the most part, from one hook to another. This force tends to draw the screen sides 24 inward toward each other during operation at a high sifting motion and will display a vertical surface vibration with a wave-like profile perpendicular to the A-A' plane. This phenomenon cannot be displayed in a rigid structure such as woven or welded wire screen or flat modular screen.

As will be best seen in FIGS. 2-5, the apertures 18 employed in the matrix 14 are, it is intended, defined by tapered walls 30, an aperture 18 having a smaller area at the top thereof than at the bottom.

A sifting screen 10 thus structured is enabled to solve problems of the prior art. While the material forming the matrix 14 is not as strong as a more rigid material, it is more elastic and vibrant which allows for a high number of operating hours. It is also significantly less expensive. Consequently, the cost per time unit of operational life achieved is more desirable.

Further, the sifting screen 10 in accordance with the present invention serves to optimize sifting operations. Because of the shape of apertures 18, occluding is deterred. Occlusion is, however, also deterred by the vibration and longitudinal movement of the media being sifted. These motions, since they occur in unison, do not cause deformation of the screen opening, thus keeping the grading very much within the desired mix. In contrast, with thin wire, when vibrating, the opening gets bigger and the larger particles will go through causing an off spec material.

The invention also facilitates transportability of the sifting screen 10. The elastomeric materials used in manufacturing the matrix 14 tend to be considerably lighter than other materials used on sifting screens in the prior art and are foldable.

A further embodiment of the invention (illustrated in FIG. 6) is one which employs modular elements 34 wherein each can be stretched and mounted on a small modular frame 36. The modular frames 36, in turn, are fixed on a large flat frame 38. While such an embodiment adds to the complexity of the apparatus, greater versatility is achieved. The modular elements 34, when they are stretched along their edges, seal the edge of the overall apparatus along tension rails. Further, they also create the longitudinal motion previously discussed so that the screen assembly will vibrate up and down and move in a wave-like profile.

FIG. 6 illustrates a large flat frame 38 capable of receiving multiple modular elements 34. It will be understood that, while only one such element 34 is illustrated, that figure illustrates multiple other loci 40 at which small modular elements 34 could be attached.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A sifting screen apparatus, comprising:

a peripheral hem portion of the sifting screen, said hem portion having a thickness smaller than that of an interior portion of the sifting screen, said hem portion further having a wire cloth array cast therein;

a shroud having upper and lower segments folded back upon each other to define a hinge and facing surfaces sandwiching said hem portion therebetween; and means for inhibiting movement of said facing surfaces across said hem portion, said movement inhibiting means comprising at least one patch of expanded metal between at least one of said facing surfaces and the hem portion.

2. The apparatus of claim 1 wherein said shroud, when facing surfaces of said segments sandwich said hem portion, is bent to define an angle which is a function of the tension rail to which the sifting screen is to be attached.

3. The apparatus of claim 2 wherein said angle is approximately 45 degrees.

4. The apparatus of claim 1 wherein said expanded metal patches have defined therein apertures, the edges of which include burrs which, when said shroud upper and lower segments are pivoted about said hinge and brought into contact with said hem portion, said burrs dig into said hem portion.

5. The apparatus of claim 4 wherein said apertures are generally diamond shaped.

6. The apparatus of claim 4 wherein said expanded metal is 18 ga steel.

7. The apparatus of claim 1 wherein said hem portion has a peripheral network of wires cast therein.

8. The apparatus of claim 1, wherein at least a substantial portion of the surface of the expanded metal presses against the hem portion of the screen.

* * * * *